US006748890B1

(12) United States Patent
Norment

(10) Patent No.: US 6,748,890 B1
(45) Date of Patent: Jun. 15, 2004

(54) DEVICE AND METHOD FOR CARRYING AND TETHERING A POWER KITE

(76) Inventor: Michael Norment, 4004 Atlantic Ave., Unit 1906, Virginia Beach, VA (US) 23451

( * ) Notice: Subject to any disclaimer, the term of this patent is extended or adjusted under 35 U.S.C. 154(b) by 0 days.

(21) Appl. No.: 10/390,860

(22) Filed: Mar. 17, 2003

(51) Int. Cl.[7] ..... B63B 35/79
(52) U.S. Cl. ..... 114/39.16; 114/102.11
(58) Field of Search ..... 114/102.11, 39.16; 244/155 A

(56) References Cited

U.S. PATENT DOCUMENTS 3,987,746 A * 10/1976 McCulloh ..... 114/254
4,708,078 A * 11/1987 Legaignoux et al. .. 114/102.23
5,366,182 A * 11/1994 Roeseler et al. ..... 244/155 R
6,065,416 A * 5/2000 Araeen ..... 114/102.11
6,513,759 B2 * 2/2003 Starbuck ..... 244/155 A
6,581,879 B2 * 6/2003 Bellacera ..... 244/155 A

* cited by examiner

*Primary Examiner*—Stephen Avila
(74) *Attorney, Agent, or Firm*—Bradley D. Goldizen

(57) ABSTRACT

A carrying strap for transporting the leading edge inflatable traction kite from a vehicle to the edge of the water as well as to and from the location to which the leading inflatable traction kite will be used is disclosed. A hands-free device and method for tethering a leading edge inflatable traction kite includes a quick release catch for attaching an end of a leash to a user while a second end of the leash is attached to the kite.

13 Claims, 11 Drawing Sheets

DEVICE AND METHOD FOR CARRYING AND TETHERING A POWER KITE

There are no related applications.

This application is not subject to federally funded research and/or development.

BACKGROUND OF THE INVENTION

Kite surfing or kite skiing is a sport that is similar to surfing or water skiing. Other sports also use leading edge inflatable (LEI) kites as their means of propulsion. During kite surfing, a kite surfer rides atop a board while using the power of the wind to inflate a kite and propel the surfer across the surface of a body of water. The kite used for kite surfing is an airfoil or flexible flying wing. Two basic types of kites are used in kite surfing, inflatable kites and RAM air kites. Lead lines, used to control the kites during kite surfing, typically extend several tens of meters above the surface of the water and are attached at one end to a "control bar", used for steering the kite, and at the other end to various points on the kite. The kite, which includes "struts" or supports that extend from the leading edge of the kite to the trailing edge, is directed by manipulating the control bar.

When transporting the kite, the lead lines of the kite are rolled around the control bar of the kite. Thereafter, the kite is placed in a tubular bag and transported to and from the point of use. To use the kite, it is pulled from the bag and the struts and leading edge are inflated. The kite is then used to convey a user along the surface of the water. Because of the size and weight of the equipment, it is cumbersome to carry the kite surfing equipment. Thus, there is a heart felt need for providing a means for easily carrying the kite and equipment. It should be noted that the "strap" may be used to transport the kite with or without the need for the bag. The kite, board or skis and the lines, collectively equipment, may be rolled in a cylindrical shape and the ends of the strap may be cinched tightly around the equipment distant from one another to create a shoulder strap. The novel arrangement of elements of the "strap" provides a carrying strap that is uniquely designed for transporting the kite.

During operation, the kite is inflated and used to pull the surfer along the surface of the water. Depending on the direction of the wind and direction in which the kite is steered, it is possible for a skilled surfer to reverse the net direction of travel. However, this is a very difficult maneuver and requires many hours of practice and experience to achieve. When first learning the sport of kite surfing, a surfer may ride the surface of the water in a down-wind direction. The surfer then steers the kite and board onto the shore and carries the kite and board or skis back to the point where the surfer began his/her surfing or skiing activities.

The task of bringing the kite and board or skis back upwind is very tiresome. The surfer must carry the board in one hand while holding and carrying the kite in the other; since the kite is very large it is difficult to control. In many instances, the surfer deflates all or part of the kite and rolls it into a bundle to carry it back upwind. This process wastes precious time and is a turnoff for many kite surfers. Thus, there is a great need for quickly and efficiently transporting the assembled and inflated kite over a great distance without carrying the kite in one's hands.

It is an object of the invention to provide a hands-free method and device for carrying a kite having its struts and leading inflatable edge inflated after it has propelled the surfer down-wind a distance.

It is another object of the invention to provide a detachable strap for transporting kite surfing equipment while it is inside a tubular bag or rolled into a bundle with at least one strut inflated.

It is an object of the invention to provide a carrier that will allow a kite surfer to easily carry the kite to and from the point of use.

BRIEF SUMMARY OF THE INVENTION

A first embodiment of the invention is a removable, adjustable strap comprised of a webbing material. The webbing includes a buckle or adjustable slide attached at each end thereof. The buckle comprises a cast or molded piece of hard material having two openings through which the webbing material may pass. The center piece of the buckle may be equipped with teeth for seizing the webbing that is passed through one of the openings. An end of the webbing material is affixed to a side of the buckle.

A first strip of hook and loop material, such as that sold under the brand name Velcro® or one-wrap®, is affixed at an opposite side of the buckle. Throughout this disclosure, the terms Velcro®, one-wrap® or hook and loop material are used interchangeably. A second strip of complementary hook and loop material is also affixed to the webbing material. Thus, each end of the webbing material has an adjustable cinch or noose which is drawn tight around an end of the rolled up kite and fastened by overlapping the strips of hook and loop material.

The strap is produced by passing an end of an elongated piece of material, such as webbing, through a first opening in the buckle that is created by a first side and the center member of the buckle. The end of the webbing is then passed through the second opening and folded over and around the second side of the buckle and fastened to itself. A portion of the webbing is then pulled through the first opening to create a loop of webbing material that extends between the first and second openings of the buckle. A first strip of hook and loop material is passed through the first opening and fastened around the first side of the buckle. A complementary strip of hook and loop material is sewn to a portion of the webbing that has been pulled through the first opening and near the first strip of hook and loop material.

During use, the surfer slides a first loop over an end of the rolled up equipment and cinches it down tight with the complementary mating strips. The second loop is slid over the opposite end of the rolled up equipment and cinched down tightly around the equipment. The surfer then carries the equipment by placing his arm or shoulder under the strap to lift and carry the equipment. Alternatively, the strap may be implemented using strips of one-wrap®, Velcro®, combinations thereof, or the like affixed at opposite ends of a strip of webbing. One-wrap® is a self-contained hook-and-loop fastener in ribbon, tape or strap form having one side comprising a surface of hooks and the other side having a surface of loops. It is designed to adhere upon self-contact. Two strips of one-wrap® are affixed to opposite sides of an end of the webbing with the same face in contact with the webbing. For example both strips may have either the hook side or the loop side in contact with the webbing. The surfer then wraps one strip around a side of the rolled up equipment in a clockwise manner and the other strip around the equipment in a counter clockwise fashion to overlap and mate with the first strip. Alternatively, complementary strips of hook and loop material may also be attached to the webbing to implement the invention.

A second embodiment of the invention comprises a leash that includes a quick fastening device such as a snap for attaching an end of the leash to the user's harness, vest or clothing. In the preferred embodiment, the leash comprises one-inch wide webbing. Complementary strips of hook and loop material are overlapped and affixed along a length of the webbing. One strip is affixed at the end of the webbing. The second strip is complementary to the first strip and is sewn or affixed a short distance from the first strip such that webbing between the two strips does not include any overlapping hook and loop material. Thus, the snap can be slid across the first strip. The first strip is then folded across and mates with the second strip. The fold preferably occurs at the webbing between the two strips.

A second end of the leash is attached to a ring, preferably a D-shaped ring. To attach the leash to a kite, the complementary strips of hook and loop material are separated from one another. The user then slides the snap across the first strip of hook and loop material to remove it from the leash to create a free end. The user then wraps the end of the leash with the ring around the center strut of the kite in the space provided between the leading edge and the center strut. The free end of the leash is passed through the ring causing a loop to be cinched about the center strut of the kite at the leading edge. The snap is slid over the free end and the complementary strips of hook and loop material are mated together to secure the snap to the leash. The snap is then attached to the user, user's clothing, personal floatation device or his/her harness or vest; thereby allowing the user to tow the kite upwind without use of his/her hands.

DETAILED DESCRIPTION OF THE INVENTION

Additional objects and advantages of the invention will be set forth in part in the description which follows, and in part will be obvious from the description, or may be learned from practicing the invention. The objects and advantages of the invention will be obtained by means of instrumentalities in combinations particularly pointed out in the appended claims.

Figure 1:
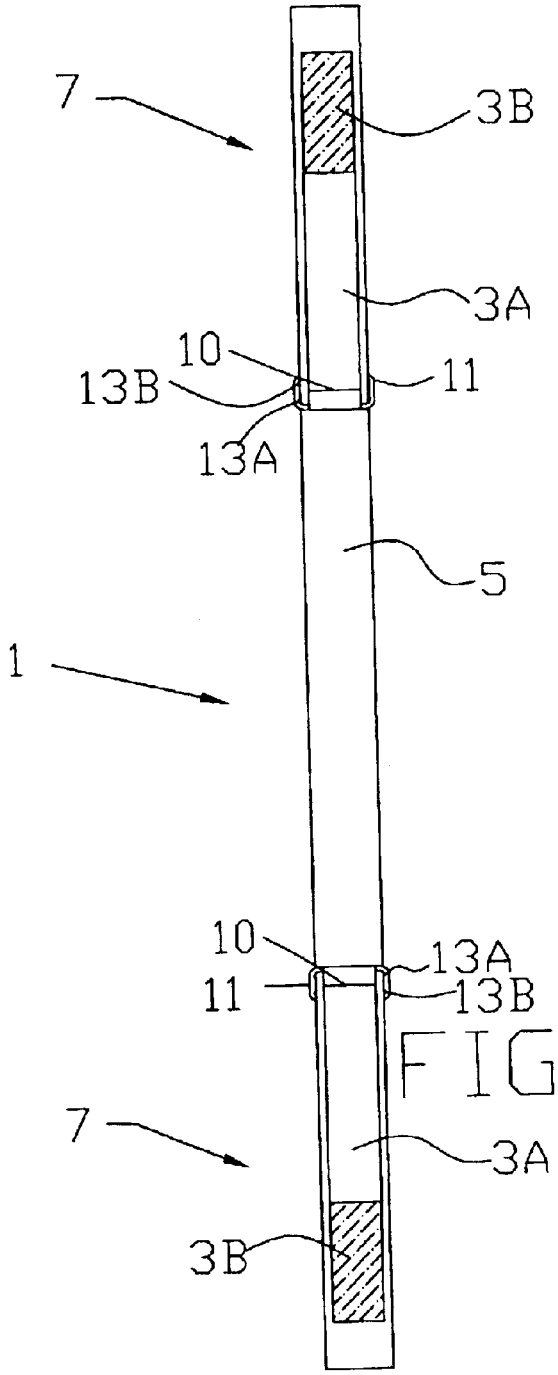
FIG. 1 is an overhead view of a strap for carrying a leading edge inflatable kite.
Figure 2A:
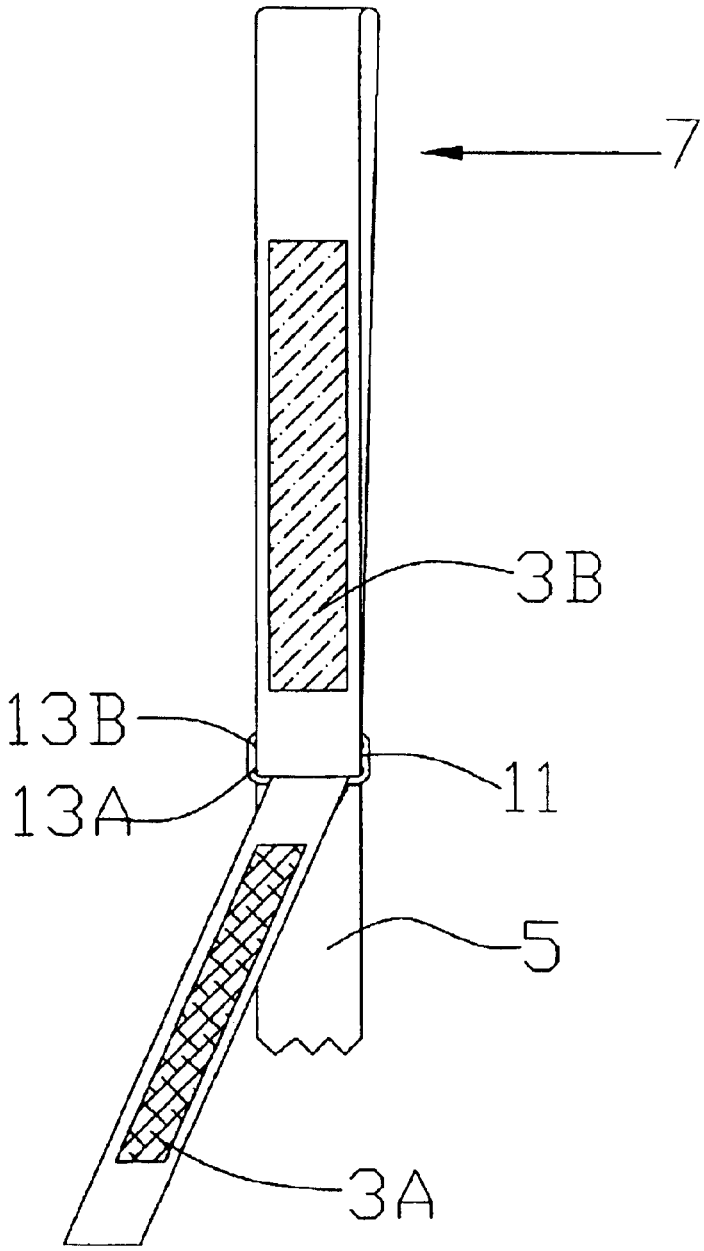
FIG. 2A is a close up view of the loop created at an end of the strap.
Figure 2B:
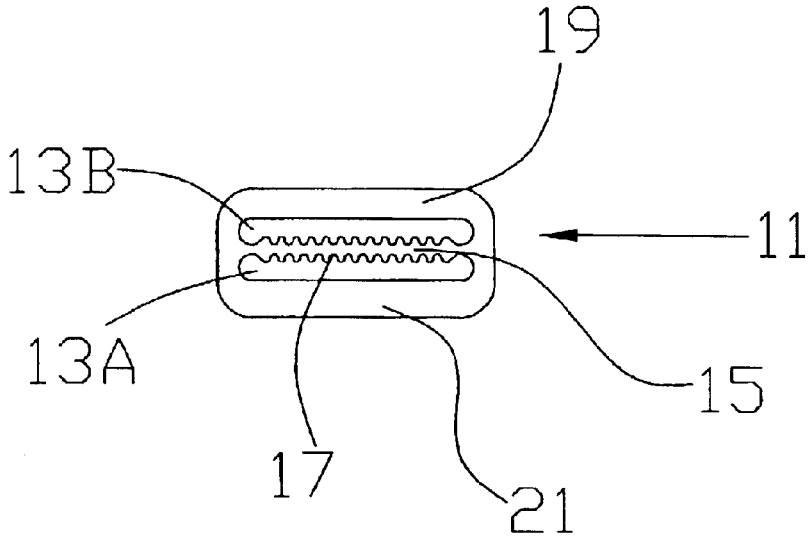
FIG. 2B is a view of the buckle.
Figure 3:
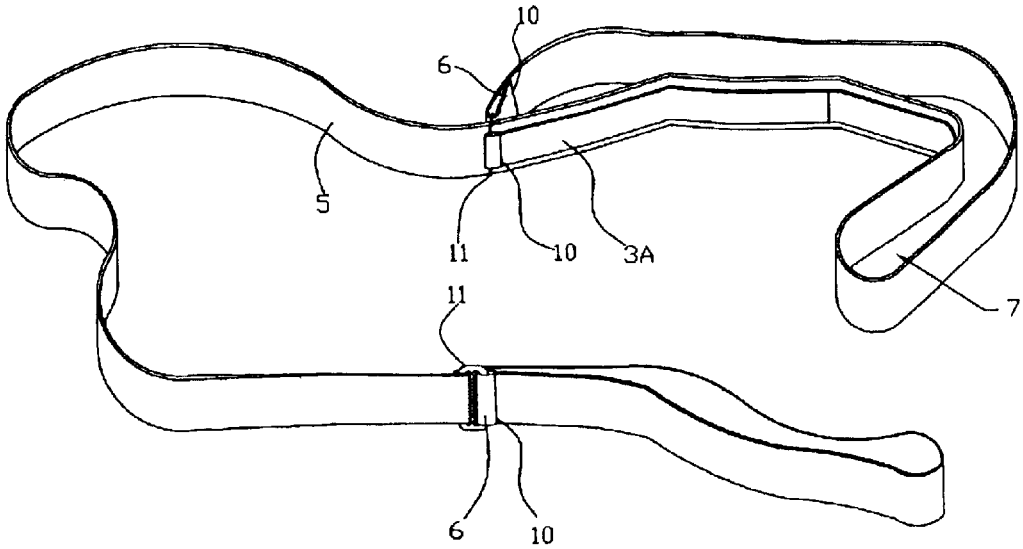
FIG. 3 is a perspective view of a first embodiment of the strap.

Referring to FIGS. 1 through 3, the strap 1 comprises two buckles 11. A first strip of hook and loop material 3A passes through a first opening 13A of buckle 11. The material 3A is attached to first side 21 of buckle 11 via stitched seam 10. An end of webbing 5 is fed through the first opening 13A and across center member 15 and through a second opening 13B to create a loop 7. The end 6 of webbing 5 is folded around a second side 19 of buckle 11 and sewn to webbing 5 via stitched seam 10 thereby creating an adjustable loop 7. A complementary strip of hook and loop material 3B is affixed or sewn to part of the webbing 5 that includes loop 7.

The first strip of hook and loop material 3A is shown as being pulled away from second strip of material 3B in FIG. 2A. As can be seen from this view, the loop 7 may be adjusted and securely fastened via the strips of hook and loop material 3A and 3B.

FIG. 3 shows a perspective view of the strap 1. Typically, the ends 6 of the webbing 5 and the first strip of the hook and loop material 3A are fastened around edges 19 and 21 of buckle 11 via seams 10. However, it is contemplated that the ends may be fastened using other types of devices or methods such that a faulty buckle may be replaced with a new one. For example, buckle 11 may be removeably fastened to webbing 5 via hook and loop material such that the buckle can be quickly removed and replaced.

Figure 4:
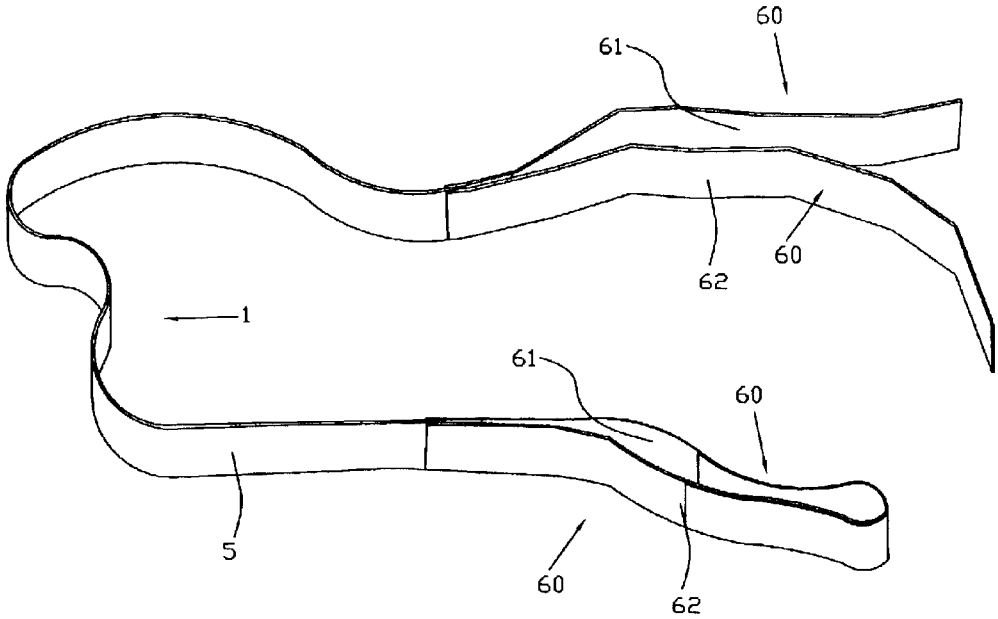
FIG. 4 is a perspective view of an alternative embodiment of the strap.

FIG. 4 depicts an alternative embodiment of strap 1 having two pairs of strips 60 of one-wrap®, Velcro® or the like affixed at opposite ends of webbing 5. The strips 60 are arranged such that hook side 62 faces outwardly on each pair 60, respectively. Alternatively, each pair may be substituted with complementary strips of hook and loop such that they will mate with each other. Loop side 61 faces inwards on both pairs of strips 60 at each end such that loop side 61 on one strip 60 faces the loop side 61 on the other strip 60. Thus, the first strip of one-wrap® or Velcro® easily mates with the second strip of one-wrap® or Velcro® when wrapped around the rolled up kite equipment.

Figure 5:
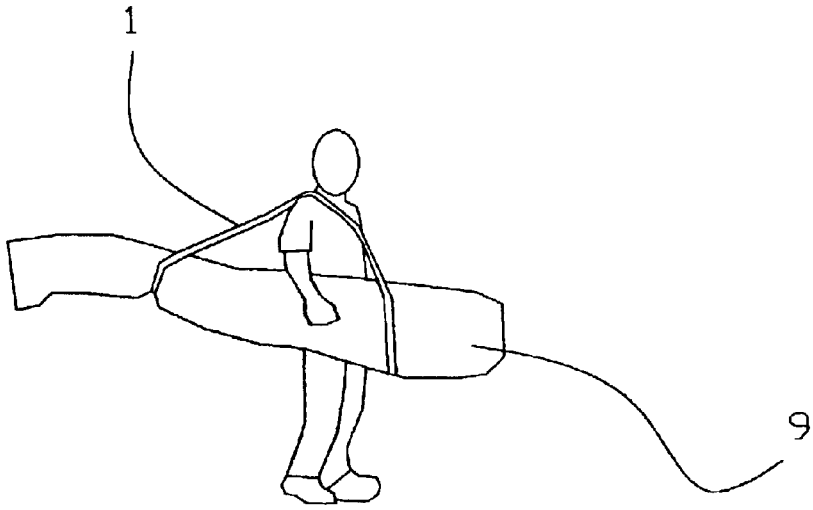
FIG. 5 depicts the strap in use.

FIG. 5 shows the strap 1 being used to carry bag 9 that includes the kite surfing equipment or the kite with at least one strut inflated. The loops 7 of the strap 1 in the first embodiment are wrapped around either ends of the bag 9 or the kite. It should be noted that shoulder pads may be added to the strap to reduce fatigue on a user's shoulder during use.

Leading edge inflatable kites include closed air bladders that are inflated before the kite is used. Some of the bladders comprise struts or supports that extend from the leading edge to the trailing edge of the kite. Material is affixed to the struts or supports and extends there between for catching air and providing positive lift to the kite. The material is inflated by the wind and used as a sail to propel the surfer in similar fashion to that of a sail boat. The kite leash is directed towards use with an LEI kite.

Figure 6:
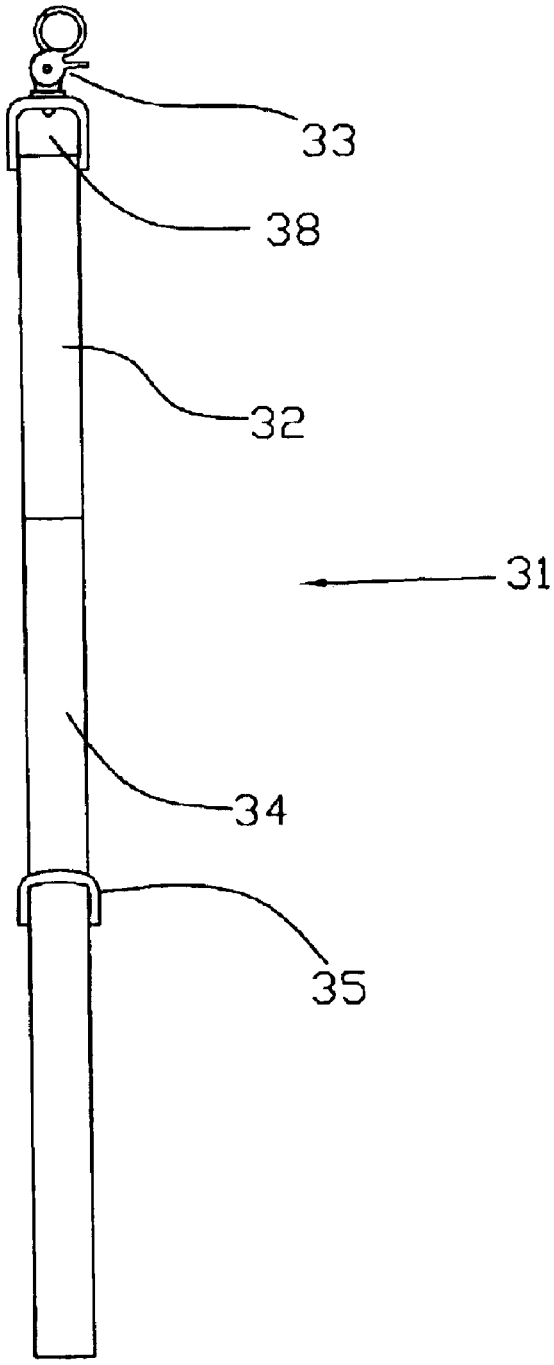
FIG. 6 shows an overhead view of a leash for a hands-free tethering method for a leading edge inflatable traction kite.

FIG. 6 is an overhead view of leash 31. The leash comprises webbing material 34. A snap 33 is removably affixed to an end of the webbing by an overlapping length 32 of webbing 34 that passes through opening 38 of the snap 33. The overlapping length 32 is fastened by complementary mating strips of hook and loop material 3A and 3B as shown in FIG. 7.

Figure 7:
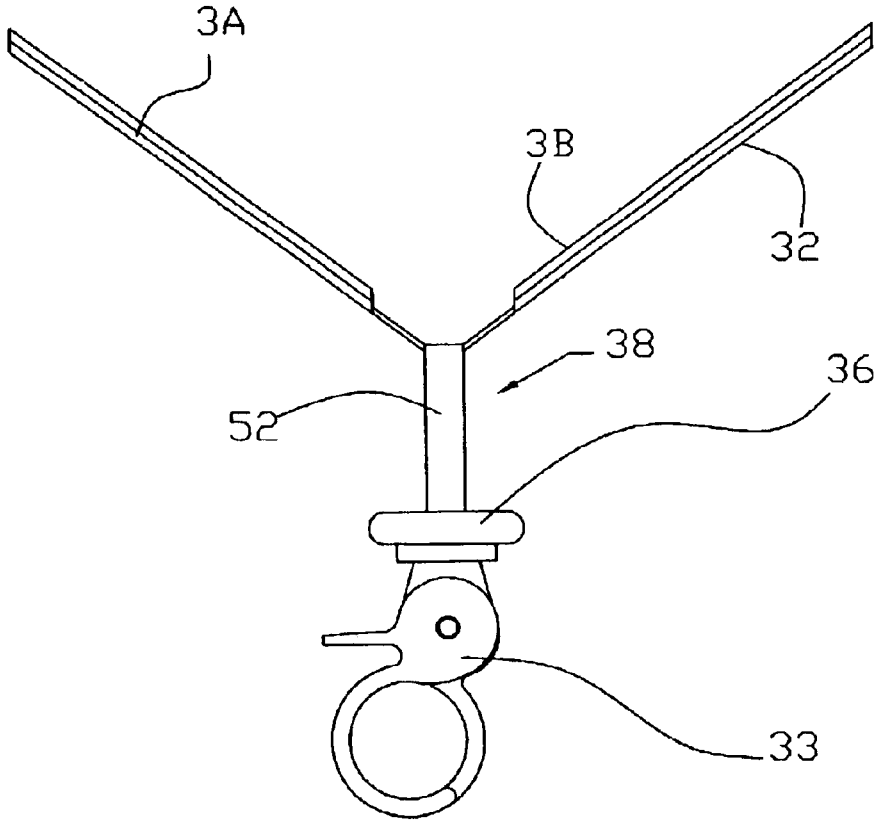
FIG. 7 is a close up of an end of the leash with the removable snap.

FIG. 7 shows the strips of hook and loop material 3A and 3B in a disengaged manner. Thus, the snap 33 may be quickly removed from leash 31 for fastening the leash 31 to a kite. The snap 33 includes an eyelet 52 that defines opening 38 for passing overlapping length 32 there through. Eyelet 52 attaches to swivel 36 which allows snap 33 to rotate freely. Strips of hook and loop material 3A and 3B are mated together to secure the snap onto the leash 31.

Figure 8:
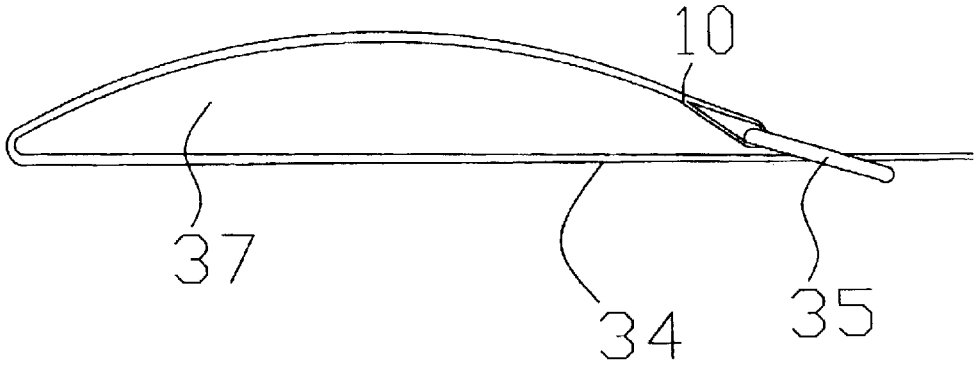
FIG. 8 is a side view of the leash.

FIG. 8 is a side view of leash 31 showing the relationship of the D-shaped ring 35 to the webbing 34. An end of the webbing passes through a D-shaped ring 35 and folds around the ring 35 and fastens to itself via seam 10 or Velcro° fastening means. This forms loop 37 which encircles the center strut of the LEI kite at the point where it meets the leading edge of the kite. In the preferred embodiment, the webbing is stitched to itself. However, it is contemplated that the D-shaped ring may be removably affixed to the end of the webbing for easy replacement. It should be noted that complementary strips of mating material such as those shown in FIG. 4, may be used to affix an end of the leash to the kite.

Figure 9:
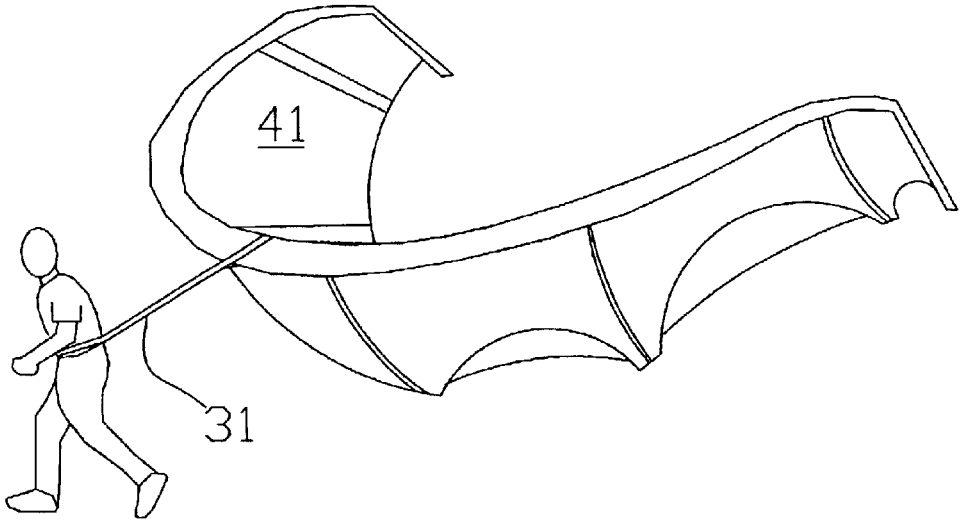
FIG. 9 depicts the leash in use.
Figure 10:
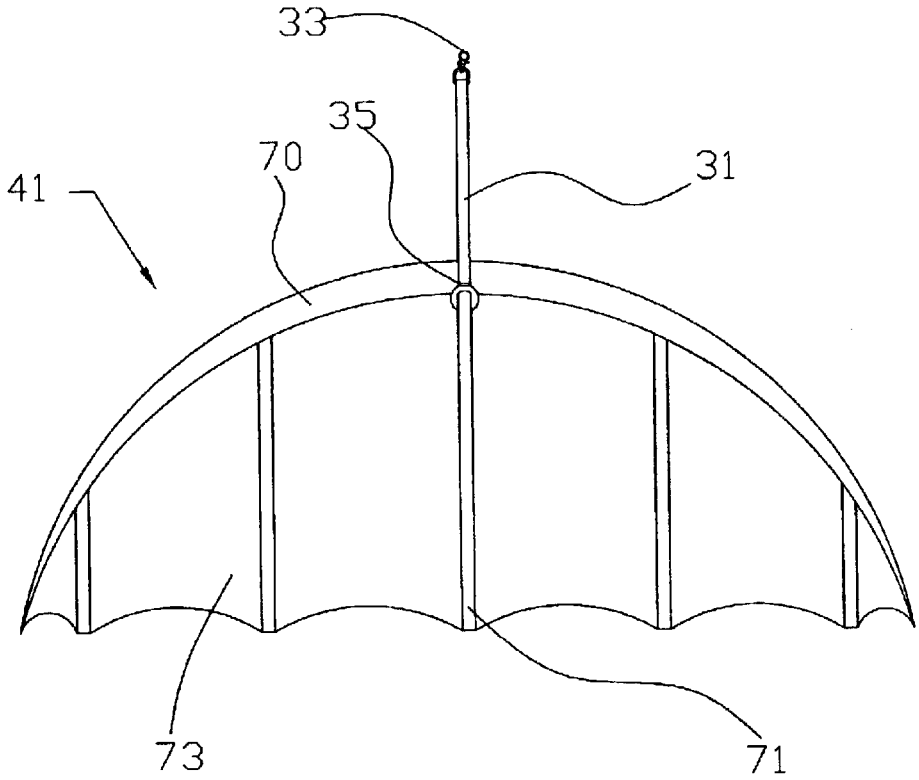
FIG. 10 is an overhead view of the leash attached to the leading edge inflatable kite.

FIGS. 9 and 10 shows the leash 31 while in use. The surfer removes the snap 33 from the leash 31. After wrapping the end of the leash 31 around the center strut 71 of the kite 41, the end is passed through the D-shaped ring 35. The snap 33 is then re-fastened to the leash 31 via strips of hook and loop material 3A and 3B and secured to the surfer, his/her clothing or vest via snap 33. Alternatively, hook and loop material 3A and 3B may be wrapped around the surfer. As the surfer moves in a forward direction away from the kite, the kite is pulled from the ground and provides positive lift. So long as the surfer continues in a direction away from the kite, the kite will remain aloft thereby allowing the surfer to transport the kite in a hands-free manner. As shown leading edge 70 is inflated helping to keep material 73 open such that it can catch air to create lift for the kite 41.

It is to be understood that the invention is not limited to the exact construction illustrated and described above, but that various changes and modifications may be made without departing from the spirit and the scope of the invention as defined in the following claims.

I claim:

1. A carrying apparatus for a leading edge inflatable traction kite having at least a leading edge deflated and at least one inflated strut, said carrying apparatus comprising:

a webbing having a length, a width, a first end and a second end;

a first strip of hook and loop material having a first end and a second end, said first end of the first strip of hook and loop material being fastened to the first end of the webbing for wrapping said second end of the first strip of hook and loop material around at least a portion of said one inflated strut near an end thereof; and, a second strip of hook and loop material having a first end and a second end, said first end of the second strip of hook and loop material being fastened to the second end of the webbing for wrapping said second end of the second strip of hook and loop material around at least a portion of said one inflated strut near an end thereof.

2. The carrying apparatus of claim 1 further comprising:

a first buckle having a first side, a second side and a middle member that create a first and second opening, said first end of the webbing passing through the first opening across the middle member through the second opening and being fastened to said second side of the first buckle to create a loop, said first end of the first strip of hook and loop material passing through the first opening of the first buckle and being secured to the first side thereof.

3. The carrying apparatus of claim 2 further comprising:

complementary hook and loop material affixed to a portion of the webbing near the first buckle for mating with the first strip of hook and loop material.

4. The carrying apparatus of claim 2 further comprising:

a second buckle having a first side, a second side and a middle member that create a first and second opening, said second end of the webbing passing through the first opening across the middle member through the second opening and being fastened to said second side of the second buckle to create a loop, said first end of the second strip of hook and loop material passing through the first opening of the second buckle and being secured to the first side thereof.

5. The carrying apparatus of claim 4 further comprising:

complementary hook and loop material affixed to a portion of the webbing near the second buckle for mating with the second strip of hook and loop material.

6. A carrying apparatus for a leading edge inflatable traction kite having at least a leading edge deflated and at least one inflated strut, said carrying apparatus comprising:

at least one buckle comprising a first side, a second side and a middle member that create a first and second opening;

a webbing having a first end and a second end, said first end passing through the first and second opening of the at least one buckle and fastening to itself to create a loop for sliding said loop over an end of at least a portion of the said one inflated strut;

a first strip of hook and loop material fastened to said webbing near the one buckle; and, a second strip of hook and loop material having two ends, one end of the second strip of hook and loop material being passed through the first opening of the buckle and fastened to said first side for mating with the first strip of hook and loop material.

7. The carrying apparatus of claim 6 further comprising:

a second buckle comprising a first side, a second side and a middle member that create a first and second opening;

said second end of the webbing passing through the first and second openings of the second buckle and fastening to itself to create a loop for sliding said loop over an end of at least a portion of the said one inflated strut;

a third strip of hook and loop material fastened to said webbing near the second buckle; and, a forth strip of hook and loop material having two ends, one end of the fourth strip of hook and loop material passing through the first opening of the second buckle and fastened to said first side of the second buckle for mating with the third strip of hook and loop material.

8. A device for tethering an inflated leading edge inflatable kite that includes inflatable struts, said device comprising:

a removable snap fastener;

a webbing having two ends, a first end for attaching to said snap fastener and a second end for attaching to an inflatable strut of the leading edge inflatable kite;

a fastening means attached to the first end of the webbing for removably attaching said removable snap fastener thereto; and, a fastening means attached to the second end of the webbing for removably attaching the leading edge inflatable kite.

9. The device of claim 8 wherein said removable snap fastener comprises an eyelet through which an end of said webbing passes and a swivel connected to said eyelet.

10. The device of claim 8 further comprising two pieces of complementary mating hook and loop strips affixed to said first end of the webbing for removably attaching the snap fastener to the webbing.

11. The device of claim 8 further comprising a D-shaped ring fastened at an end of the webbing opposite the snap fastener.

12. A hands-free method of tethering an inflated leading edge inflatable traction kite to a surfer comprising:

attaching a first end of a webbing to a surfer, surfer's clothing, vest or harness; and, attaching a second end of a webbing to the leading edge inflatable traction kite;

wherein said surfer walks away from the leading edge inflatable traction kite causing said kite to experience positive lift and float behind the surfer so long as he continues to walk away from the leading edge inflatable traction kite.

13. The hands-free method of claim 12 further comprising passing the first end of the webbing around a portion of said leading edge inflatable kite and through a D-shaped ring attached to the second end of the webbing.

* * * * *